US005398649A

United States Patent [19]

Shimamoto

[11] Patent Number: 5,398,649

[45] Date of Patent: Mar. 21, 1995

[54] S.O.H.C. FIVE VALVE ENGINE

[75] Inventor: Makoto Shimamoto, Iwata, Japan

[73] Assignee: Yamaha Hatsudoki Kabushiki Kaisha, Iwata, Japan

[21] Appl. No.: 970,109

[22] Filed: Nov. 2, 1992

[30] Foreign Application Priority Data

Nov. 8, 1991 [JP] Japan ..... 3-320928
Nov. 8, 1991 [JP] Japan ..... 3-320929

[51] Int. Cl.[6] ..... F01L 1/26
[52] U.S. Cl. ..... 123/90.23; 123/90.27
[58] Field of Search ..... 123/90.22, 90.23, 90.27, 123/90.39, 90.4, 90.48, 90.15, 90.16, 90.17, 193.5

[56] References Cited

U.S. PATENT DOCUMENTS

| | | | |
|---|---|---|---|
| 1,306,949 | 6/1919 | Coatalen | 123/90.22 |
| 3,219,019 | 11/1965 | Palmer | 123/90.27 |
| 3,882,832 | 5/1975 | Ohsaki et al. | 123/90.17 |
| 4,267,811 | 5/1981 | Springer | 123/193.5 |
| 4,335,686 | 6/1982 | Herdin et al. | 123/90.27 |
| 4,624,222 | 11/1986 | Yoshikawa | 123/90.27 |
| 4,638,774 | 1/1987 | Aoi | 123/90.4 |
| 4,662,323 | 5/1987 | Moriya | 123/90.27 |
| 4,714,058 | 12/1987 | Oda et al. | 123/90.22 |
| 4,911,113 | 3/1990 | Yamada | 123/90.27 |
| 5,027,761 | 7/1991 | Fujii et al. | 123/90.23 |
| 5,095,859 | 3/1992 | Iwata et al. | 123/90.27 |
| 5,099,812 | 3/1992 | Yamada | 123/90.22 |
| 5,101,778 | 4/1992 | Fukuo et al. | 123/90.27 |
| 5,127,380 | 7/1992 | Morishita | 123/90.4 |
| 5,163,390 | 11/1992 | Shimamoto | 123/90.27 |

FOREIGN PATENT DOCUMENTS

| | | | |
|---|---|---|---|
| 49106 | 6/1991 | European Pat. Off. | 123/90.27 |
| 49-15162 | 4/1974 | Japan . | |
| 60-113004 | 6/1985 | Japan . | |
| 60-128909 | 7/1985 | Japan . | |
| 63-18107 | 1/1988 | Japan . | |
| 63-100602 | 6/1988 | Japan . | |
| 63-191207 | 12/1988 | Japan . | |
| 2-40904 | 3/1990 | Japan . | |
| 2-70908 | 3/1990 | Japan . | |

*Primary Examiner*—Andrew M. Dolinar
*Assistant Examiner*—Weilun Lo
*Attorney, Agent, or Firm*—Knobbe, Martens, Olson & Bear

[57] ABSTRACT

A number of embodiments of single overhead camshaft five valve per cylinder internal combustion engines. The camshaft and valve operating mechanism is designed so as to permit a compact assembly by placing the camshaft outwardly of the area between the valves. Both direct and rocker arm valve actuation embodiments are disclosed although in the direct valve operating arrangement, rocker arms are employed for operating some of the valves. The valve and bearing arrangement for the camshaft permits the cam lobes to be positioned closely adjacent each other to maintain compactness of the engine design. In all embodiments, a central spark plug position is accommodated and the spark plug extends generally parallel to the axis of the associated cylinder bore.

41 Claims, 7 Drawing Sheets

S.O.H.C. FIVE VALVE ENGINE

BACKGROUND OF THE INVENTION

This invention relates to a valve arrangement for an internal combustion engine and more particularly to an five valve per cylinder single overhead camshaft internal combustion engine.

The advantages of using multiple valves for each cylinder of an engine are well known. One arrangement which appear to provide optimum results is a so-called "five valve" engine wherein each cylinder of the engine is served by five poppet valves. Normally such arrangements employ three intake valves and two exhaust valves. Although the use of multiple valves increases engine performance, there are a number of problems in connection with the location and actuation of multiple valves, particularly those having five or more in number.

Conventionally the valves for a cylinder head are disposed at angular relationships to a vertically extending plane passing through the center of the combustion chamber with the intake valves being located on one side and the exhaust valves located on another side. Although it has been proposed to employ a separate intake camshaft and an exhaust camshaft for operating the intake and exhaust valves, there are a number of reasons why single overhead camshaft engines may be preferred. For example, single overhead camshaft engines have a less complex cam arrangement and also the problem of synchronizing two camshafts with the crankshaft and maintaining appropriate tension and short chain lengths are simplified with single overhead cam engines.

In one proposed arrangement, the single overhead camshaft passes through the center plane of the cylinder or substantially in line with it and the valves are operated by short rocker arms. However, this type of actuating mechanism places all of the valve operating system directly between the valves and thus makes central spark plug placement difficult. If the spark plug has its gap at a central location, this normally must be accomplished by mounting the spark plug at a considerable angle to the cylinder bore axis and this is not always desirable.

In addition to the aforenoted defect, it is also desirable to maintain the valve axis at a very small angle to the cylinder bore axis so as to maintain a relatively shallow combustion chamber. This is particularly important when multiple valves are employed so as to reduce the surface area of the combustion chamber and permit high compression ratios. However, if the angle of the intake and exhaust valves is made narrow, the space between them becomes quite small and it is difficult to provide a single overhead camshaft in this area with the necessary rocker arm arrangement for operating all of the valves.

It is, therefore, a principal object of this invention to provide an improved cylinder head layout arrangement for a multiple valve engine.

It is a further object of this invention to provide an improved, single overhead cam, five valve per cylinder, cylinder head and valve arrangement.

It is a further object of this invention to provide an improved cylinder head arrangement embodying a single overhead camshaft, five valves per cylinder, and affording a central spark plug location with the spark plug extending generally parallel to the cylinder bore axis.

Another problem associated with single overhead camshaft multiple valve engines is that the length of the engine in the direction of the axis of rotation of the camshaft tends to become long and can increase the spacing between adjacent cylinder bores and provide an unduly long engine. This problem is partially caused by the number of cam lobes that must be employed for operating the multiple valves and also the placement of the bearing arrangement for rotatably journaling the camshaft.

It is, therefore, another object of this invention to provide an improved cylinder head arrangement for a single overhead camshaft engine wherein the single overhead camshaft has multiple cam lobes for operating multiple valves.

It is a further object of this invention to provide an improved bearing arrangement for rotatably journaling a camshaft having a plurality of cam lobes associated with each cylinder of the engine.

In conjunction with the use of single overhead cam engines, an arrangement has been proposed wherein some of the valves are directly operated by the camshaft while other valves are operated by rocker arms. Such an arrangement necessitates separate cam lobes for each rocker arm and each directly operated valve. However, when some of the valves are directly operated, the adjacent cam lobes must be positioned so as to avoid interference with the directly operated valve. This can also increase the length of the engine.

It is, therefore, a still further object of this invention to provide an improved valve arrangement for a multiple valve engine wherein certain valves are directly operated by the camshaft and others are operated through rocker arms while maintaining a short overall length for the valve actuating mechanism.

SUMMARY OF THE INVENTION

A first feature of this invention is adapted to be embodied in a cylinder head assembly for a five valve, single overhead camshaft engine. The engine comprises a cylinder head that defines at least in part a combustion chamber. A first set of three valves is supported for reciprocation along respective axes by the cylinder head on one side of a first plane passing through the combustion chamber. A second set of two valves is supported for reciprocation along respective axes by the cylinder head on the other side of the first plane. A camshaft is journaled for rotation relative to the cylinder head about an axis that is parallel to the plane and which lies on the one side thereof. Means are provided for actuating the first set of valves from the camshaft comprising at least a first cam lobe positioned substantially on a second plane that is perpendicular to the first plane and passing through the center of the combustion chamber. A pair of cam lobes are positioned on opposite sides of the first cam lobe and a pair of rocker arms each engage a respective one of the pair of cam lobes and a respective one of the second set of valves for operating the second set of valves from the camshaft. A spark plug is mounted in the cylinder head between the pair of rocker arms.

Another feature of the invention is adapted to be embodied in a single overhead camshaft arrangement for a multiple valve internal combustion engine comprising a cylinder head that is adapted to be affixed to the cylinder block to close one end of a cylinder bore formed therein. A camshaft is supported for rotation relative to the cylinder head by a pair of bearings that are spaced apart at a distance substantially equal to the diameter of the bore. At least four cam lobes are formed on the camshaft between the spaced bearings for operating a plurality of valves supported in the cylinder head for reciprocation and serving the cylinder bore.

Another feature of the invention is adapted to be embodied in a cylinder head arrangement for an overhead camshaft internal combustion engine which forms in part a combustion chamber for the engine. At least three poppet valves are provided in the cylinder head for serving the combustion chamber. A tappet is slidably supported within the cylinder head and is associated for one of the valves for operating that one valve. A camshaft is journaled for rotation relative to the cylinder head and has a first lobe cooperating with the tappet for operating the one valve. A pair of lobes are disposed on opposite sides of the first lobe and in a position to overlap the tappet. Means are provided for operating the remaining two poppet valves from the pair of cam lobes, respectively.

DETAILED DESCRIPTION OF THE PREFERRED EMBODIMENTS OF THE INVENTION

Figure 1:
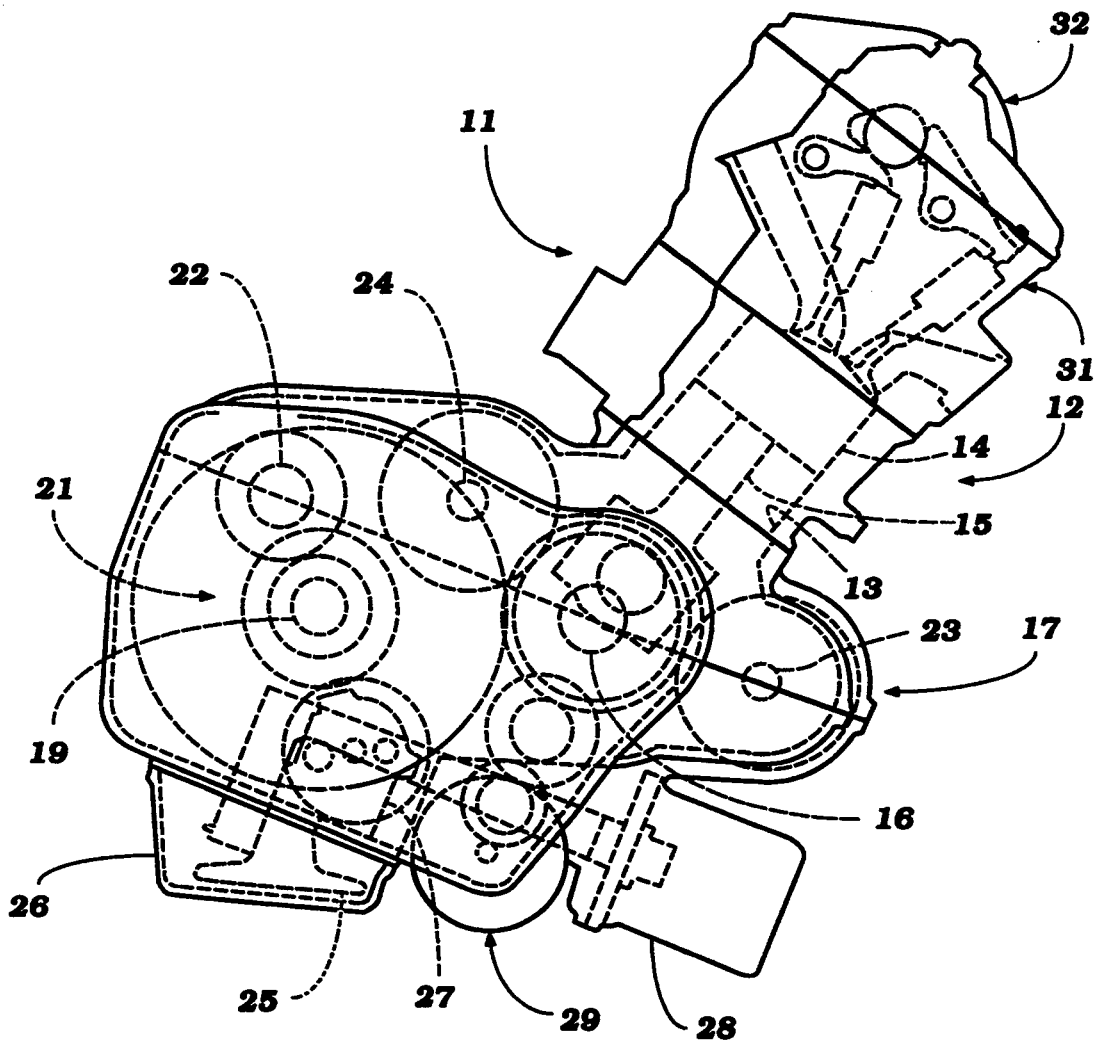
FIG. 1 is a side elevational view of a motorcycle engine constructed in accordance with an embodiment of the invention.

Referring first to FIG. 1, an internal combustion engine constructed in accordance with an embodiment of the invention and adapted for use in a motorcycle is identified generally by the reference numeral 11. A motorcycle environment is described because the invention has particular utility in the powering of motor vehicles and particularly in those having a compact nature and requiring a compact construction. It will be readily apparent to those skilled in the art, however, that the invention can be equally well practiced with other applications for internal combustion engines.

In the illustrated embodiment, the engine 11 is of the two cylinder in-line type and includes a cylinder block 12 that is inclined from the vertical in a forward direction so as to provide a low center of gravity and which is formed with a pair of cylinder bores 13. Pistons 14 are supported for reciprocation within the cylinder bores 13 and are connected by means of respective connecting rods 15 to a crankshaft 16 that is rotatably journaled within a crankcase assembly, indicated generally by the reference numeral 17.

As is typical with motorcycle practice, the crankcase assembly 17 also includes a change speed transmission which includes a reduction gear 20 that is engaged with a further reduction gear 18 of a transmission main or primary shaft 19. A clutch mechanism (not shown) drives the transmission primary shaft 19 and there are a plurality of intermeshing change speed gear sets 21 provided on the primary shaft 19 and a secondary or output shaft 22, as is well known in this art.

A pair of balancer shafts 23 and 24 are journaled within the crankcase assembly 17 on opposite sides of the crankshaft 16 and are driven from the gear 20 for balancing purposes.

The engine 11 also includes a lubrication system that is comprised of an oil pickup 25 that draws oil from a lower sump 26 of the crankcase 16 for supply to a pressure pump 27. The pressure pump 27 discharges the lubricant through an oil filter 28 to the lubrication system of the engine.

An electric starter 29 is also mounted on the side of the crankshaft 16 for electric starting of the engine in a well known manner.

The construction of the engine 11 and the transmission associated with it, as thus far described, may be considered to be conventional. For that reason, further details of this portion of the engine are not believed to be necessary to understand the construction and operation of the embodiments of the invention.

The invention relates to the cylinder head assembly, indicated generally by the reference numeral 31, which is affixed to the cylinder block 12 in a manner which will be described and the valving arrangement and porting therein. This cylinder head assembly 31 is closed by a cam cover 32 which is fixed to the cylinder head 31 in a manner which will also be described.

Referring now primarily to FIGS. 2–5, the construction of the cylinder head assembly 31 and its related components will now be described. The cylinder head 31 has a lower surface 33 that is held in sealing arrangement with the upper end of the cylinder block 12 in a manner which will be described. This sealing surface 33 extends around individual recesses 34 which form, in part, the combustion chambers of the engine along with the cylinder bores 13 and the heads of the pistons 14. A plurality of openings 35 are formed in the cylinder head 33 in equally spaced relationship to the cylinder bores and pass studs 36 that are threaded into the cylinder block. Either cap nuts 37 or socket headed nuts 38 are affixed to the upper ends of the studs 36 so as to affix the cylinder head 31 to the cylinder block.

The lefthand side of the cylinder head as shown in FIGS. 2–5 forms the intake side and there is provided a pair of Siamese type intake passages 39 which open through an outer side surface 41 of the cylinder head 31 and are connected to any suitable induction system which may include a charge former or charge formers. The intake passages 39 extend through the cylinder head and terminate at the cylinder head recesses 34 in a pair of spaced side intake valve ports formed by valve seats 42 and a center valve intake port formed by a valve seat 43. The valve seats 42 and 43 are pressed into the cylinder head assembly 31 in a well known manner. The side intake valve ports 42 are controlled by side intake valves 44 that are slidably supported in valve guides 45 which are also pressed into the cylinder head assembly 31. These intake valves 44 reciprocate about axes 46 that lie in a common plane that is disposed at an acute angle $\theta_1$ to a first plane containing the axis 47 of the cylinder bore 13 and extending perpendicularly to the plane of FIG. 3.

A center intake valve 48 is slidably supported in a valve guide (not shown) and reciprocates along an axis 49 which is disposed also at an acute angle to the plane containing the cylinder bore axis 47 but which acute angle $\theta_2$ is less than the acute angle $\theta_1$ of the axes 46.

The intake valves 44 and 48 are all urged to their closed positions by respective valve springs 51 which act between keeper retainer assemblies 52 fixed to the upper ends of the valve stems and bearing plates 53 that engage the upper surface of the cylinder head. The intake valves 48 and 46 are opened in a manner which will be described. It should be noted that the side intake valves 47 are placed so that their heads extend slightly over the first plane containing the cylinder bore axis 47.

On the opposite side of the first plane from the intake passages 39, there are provided Siamese type exhaust passages 54 which extend from an opening in a side face 55 of the cylinder head 32 opposite to the side face 41 through which the intake passages 39 extend. The exhaust passage 54 diverges into a pair of sections each of which terminates in a valve port formed by a valve seat insert 56 pressed into the cylinder head 31. Exhaust valves 57 are slidably supported within the cylinder head 31 by pressed-in valve guides. The exhaust valves 57 for each cylinder bore 13 have their reciprocal axes lying in a common plane that is disposed at an acute angle to the first plane containing the cylinder bore axis 47. The acute angle of the exhaust valves 57 lies between the angles $\theta_1$and $\theta_2$ of the intake valves 44 and 48, respectively.

Coil compression springs 58 act between keeper retainer assemblies 59 fixed to the stems of the exhaust valves 57 and bearing plates 61 acting against the cylinder head 31 to urge the exhaust valves 57 to their closed positions. The exhaust valves 57 are opened in a manner to be described.

All of the intake valves 44 and 48 and the exhaust valves 57 are operated by means of a single overhead camshaft, indicated generally by the reference numeral 62 and which is disposed on the intake side of the first plane containing the cylinder bore axis 47. The camshaft 62 is supported by means of a plurality of bearing assemblies, indicated generally by the reference numeral 63, which cooperate with bearing surfaces 64 (FIG. 4) that are formed intermediate the ends of the camshaft 62 and at the ends of the camshaft 62. The bearing surfaces 64 are disposed at a distance that is spaced apart approximately equal to the diameter of the cylinder bores 13 so that the center bearing surface 64 will be disposed between the two cylinder bores 13, for a reason which will be described.

The cylinder head bearings 63 are comprised of a bearing surface 65 formed integrally with the upper part of the cylinder head 31 and bearing caps 66 which are affixed to the cylinder head bearing surface 65 by threaded fasteners 67. The axis of rotation of the camshaft 62 is substantially in line with the cylinder head bores 35 that pass the threaded fasteners 36 that receive the socket headed nuts 38. In order to permit torquing of the head without removing the camshaft 62, the camshaft 62 is provided with a plurality of bores 68 which can be aligned with corresponding bores 69 formed in the bearing caps 66. The bores 68 and 69 are sized so as to pass a key for tightening the socket headed nuts 38. In this way, the cylinder head can be torqued without necessitating removal of the camshaft or the camshaft bearings.

Elastic plugs 71 are pressed into the bores 69 of the bearing caps 66 and are held in place by lugs 72 (FIG. 4) of the cam cover 32. The cam cover 32 is affixed to the cylinder head 32 by threaded fasteners 73.

Figure 2:
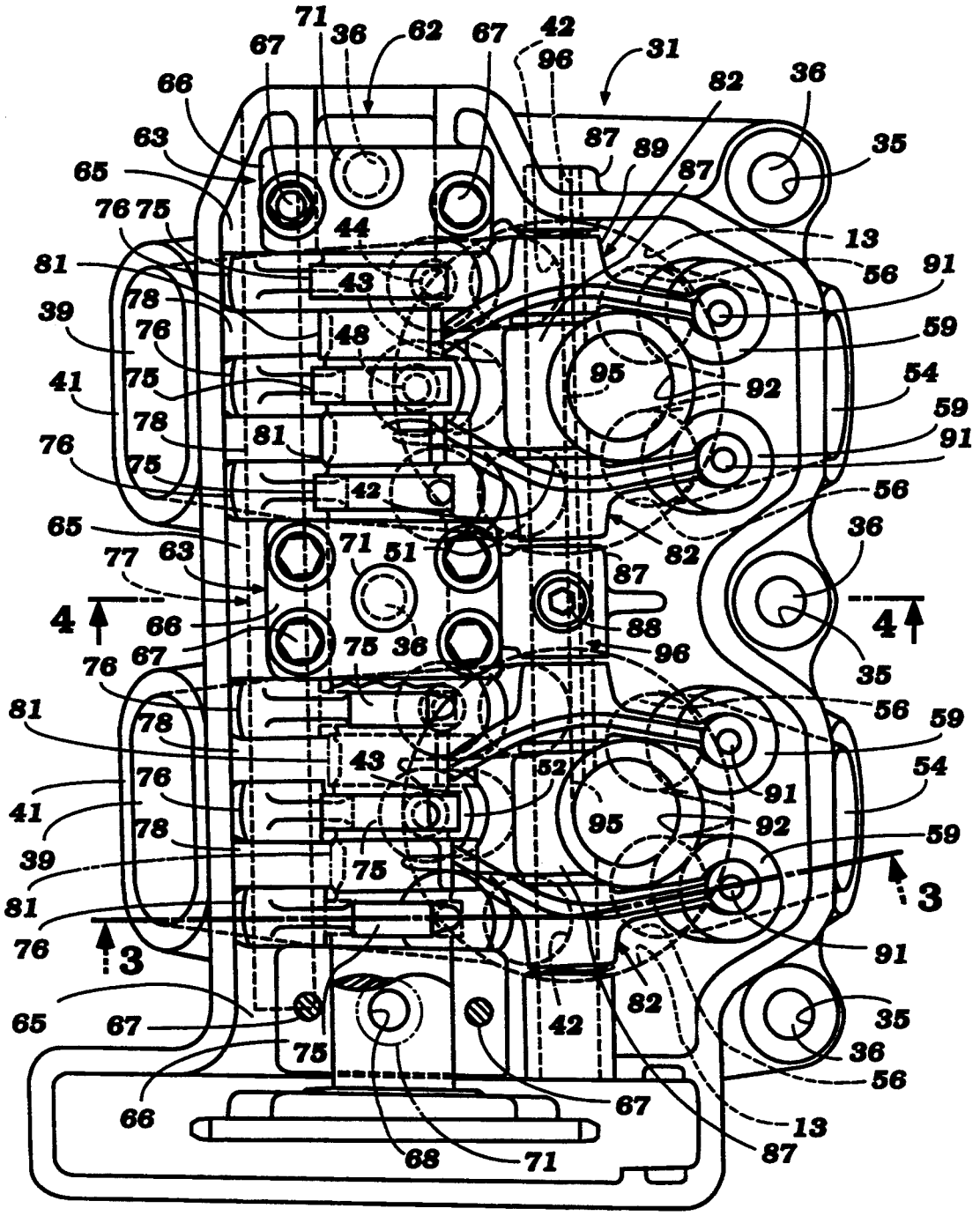
FIG. 2 is a top plan view of the cylinder head of this embodiment with the cam cover removed so as to more clearly show the construction.
Figure 3:
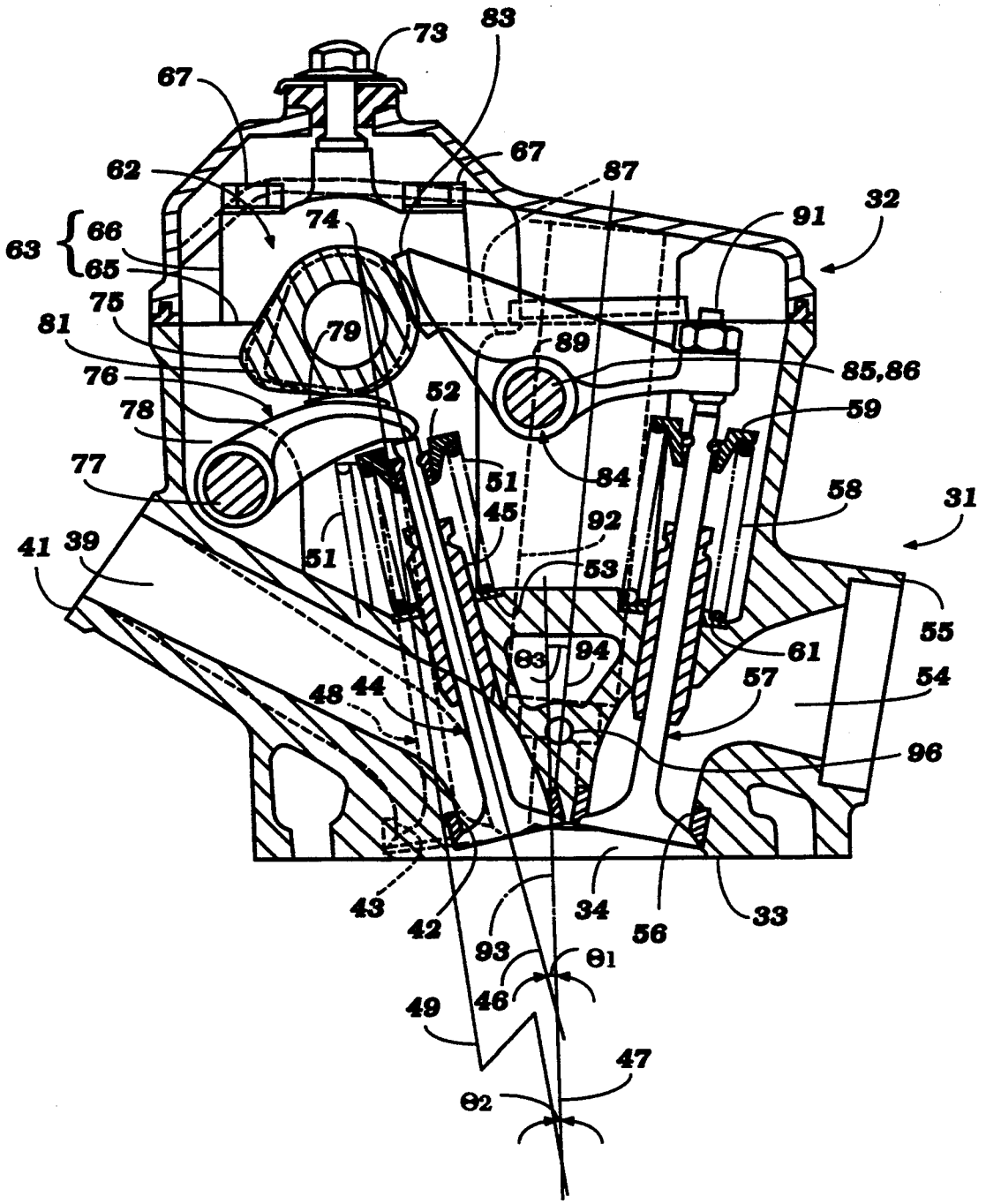
FIG. 3 is a cross-sectional view taken along the line 3—3 of FIG. 2.
Figure 4:
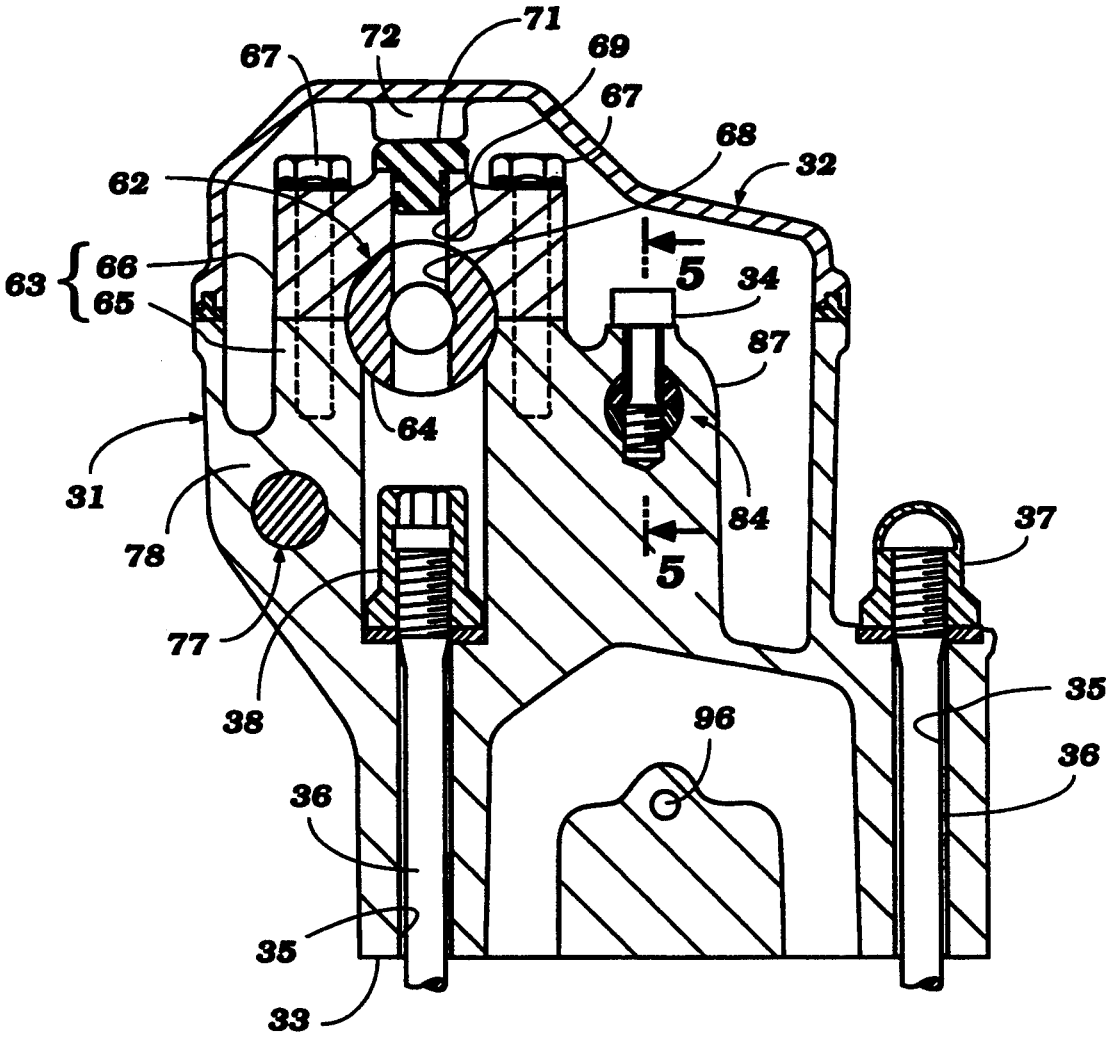
FIG. 4 is a cross-sectional view taken along the line 4—4 of FIG. 2.
Figure 5:
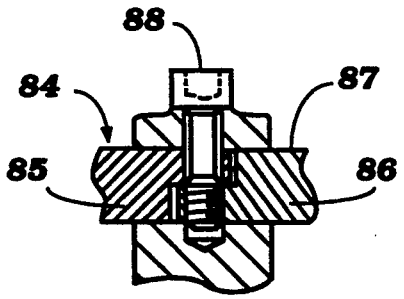
FIG. 5 is a cross-sectional view taken along the line 5—5 of FIG. 4.

It should be noted that planes containing the axes of reciprocation of the intake valves 44 and 48 intersect at a point beyond the tips of these intake valves and one which lies on the heel diameter of the camshaft 62 as clearly shown in FIG. 2 wherein the intersection point is designated at 74.

The camshaft 62 is, in this embodiment, provided with three intake cam lobes 75, one for each of the intake valves 44 and 48. The three intake lobes 75 are disposed so that the two outermost lobes are adjacent the camshaft bearing 63 while the center lobe is disposed in line with a second plane perpendicular to the previously mentioned first plane containing the cylinder bore axis 47 and also containing this axis. Each intake cam lobe 75 cooperates with a respective rocker arm 76, which rocker arms are all journaled on a common intake rocker arm shaft 77. This rocker arm shaft 77 is supported within a plurality of bosses 78 formed by the cylinder head 31 with the bosses 78 being disposed between adjacent intake cam lobes 75, as clearly seen in FIG. 2.

The rocker arms 76 have follower portions 79 which are engaged by the intake cam lobes 75 of the camshaft 62. The tips of the rocker arms 76 engage the upper ends of the stems of the intake valves 44 and 48 so as to operate these valves. As has been previously noted, the intake valves 44 have their axes 46 reciprocating within a common plane, while the intake valve 48 has its axis 49 disposed in a plane that is at a different angle to the plane of the intake valve axes 46. As a result of this angular disposition, the intake cam lobe 75 associated with the center intake valve 48 is rotated slightly relative to the cam lobes 75 which operate the end or side intake valves 44 so that all intake valves 44 and 48 will open and close at the same time. If desired, however, the cam lobes can be configured so that the intake valves 44 and 48 do not open and close at the same time so as to provide a staged operation in the event it is desired to establish a different type of flow pattern within the cylinder bore 13.

Between the center intake cam lobe 75 and the end intake cam lobes 75, there are formed a pair of exhaust cam lobes 81. Thus, there is one exhaust cam lobe 81 for each exhaust valve 57. It should be noted that the exhaust cam lobes 81 are positioned closely adjacent the intake cam lobes 75 and, in fact, the exhaust cam lobes 81 overlap the keeper retainer assemblies 52 of the intake valves 44 and 48. This permits a very compact assembly. In order to avoid any interference, the exhaust cam lobes 81 have a smaller outer peripheral surface than the intake cam lobes 75, as may be clearly seen in FIG. 3. In this way, there is adequate clearance between the exhaust cam lobes 81 and the keeper retainer assemblies 52 of the intake valves 44 and 48.

Pairs of exhaust rocker arms 82 are provided for each cylinder with each rocker arm 82 having a follower surface 83 that engages the exhaust cam lobes 81. It should be noted that this point of engagement is approximately 90° displaced from the point of engagement of the intake cam lobes 75 with the intake rocker arm 76.

The exhaust rocker arms 82 are all journaled on a single rocker arm shaft assembly, indicated generally by the reference numeral 84, and which, in fact, is made up of two shaft segments 85 and 86 (FIG. 5) which have interlocking ends. The rocker arm shaft assembly 84 is supported in bosses 87 of the cylinder head 31. The center of these bosses 87 receives a socket headed screw 88 for holding the rocker arm shaft assembly 84 in place and retaining the shaft segments 85 and 86 in their locations.

It will be noted that the exhaust rocker arms 82 have a bearing portion 89 that is offset from their follower portion 83 toward the end intake cam lobes 75 so that they lie in approximate alignment with these cam lobes. This also assists in providing a compact assembly and has another purpose which will be described later.

From their bearing portions 89, the rocker arms 82 then bend again inwardly and terminate in ends in which adjusting screws 91 are provided so as to permit lash adjustment and to engage the tips of the exhaust valves 57 for operating them. The curved shape of the exhaust rocker arms 82 accommodates a spark plug well 92 which is disposed substantially centrally of the combustion chamber recess 34 so that a spark plug may be positioned in this well 92 with its gap 93 (FIG. 3) disposed substantially at the cylinder bore axis 47. The center of the spark plug well 92 is indicated by the line 94 and this line is nearly vertical, being offset from the vertical and the axis 47 by a small angle $\theta_3$ which angle is approximately six degrees (6°). It should be noted that the spark plug wells 92 actually extend into the area where the center rocker arm bosses 87 are located and these bosses and a portion of the rocker arm shaft assembly 84 is provided with a small clearance recess 95. However, this does not interfere with the unitary assembly of the rocker arm shaft assembly 84. Thus, it should be readily apparent that this construction permits ease of access for the spark plugs, a central location, and still permits five valves to be operated for a single cylinder without interference.

A bore 96 is formed that extends through one end of the cylinder head 31 and intersects the bottoms of the spark plug wells 92 so that any water which may accumulate in them can drain out of the one end of the engine.

Figure 6:
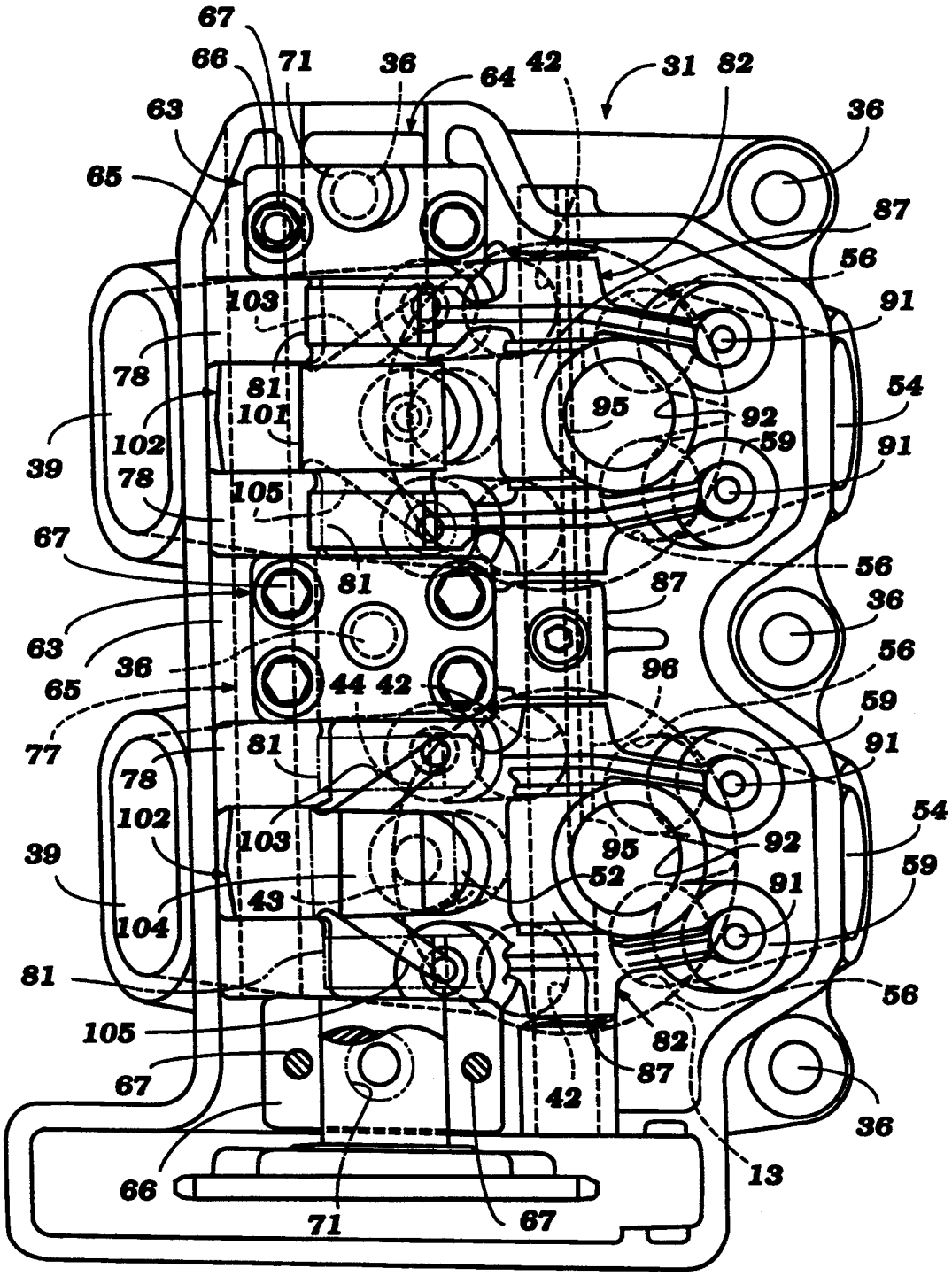
FIG. 6 is a top plan view, in part similar to FIG. 2, and shows another embodiment of the invention.

In the embodiment thus far described, the three intake valves have each been operated from a separate lobe through a separate rocker arm. FIG. 6 shows another embodiment of the invention wherein all three valves are operated by a common lobe on the camshaft and by a trifurcated rocker arm. Because this is the only difference from the previously described embodiments, components which are the same as those of the previous embodiments have been identified by the same reference numeral and will be described again, only insofar as is necessary to understand the construction and operation of this embodiment.

In this embodiment, the exhaust camshaft lobes 81 are disposed immediately adjacent the cylinder head bearings 63 that journal the camshaft 62 and, accordingly, adjacent the camshaft bearings surfaces. A single intake lobe 101 is provided on the camshaft for each cylinder and this single lobe 101 operates a rocker arm 102 which is mounted on the rocker arm shaft 77 in a manner previously described. The rocker arms 102 have three forked ends 103,104 and 105, each of which engages a respective one of the intake valves 44 or 48. In all other regards this embodiment is the same as that previously described, as already noted and, for that reason, further description of this embodiment is believed to be unnecessary.

Figure 7:
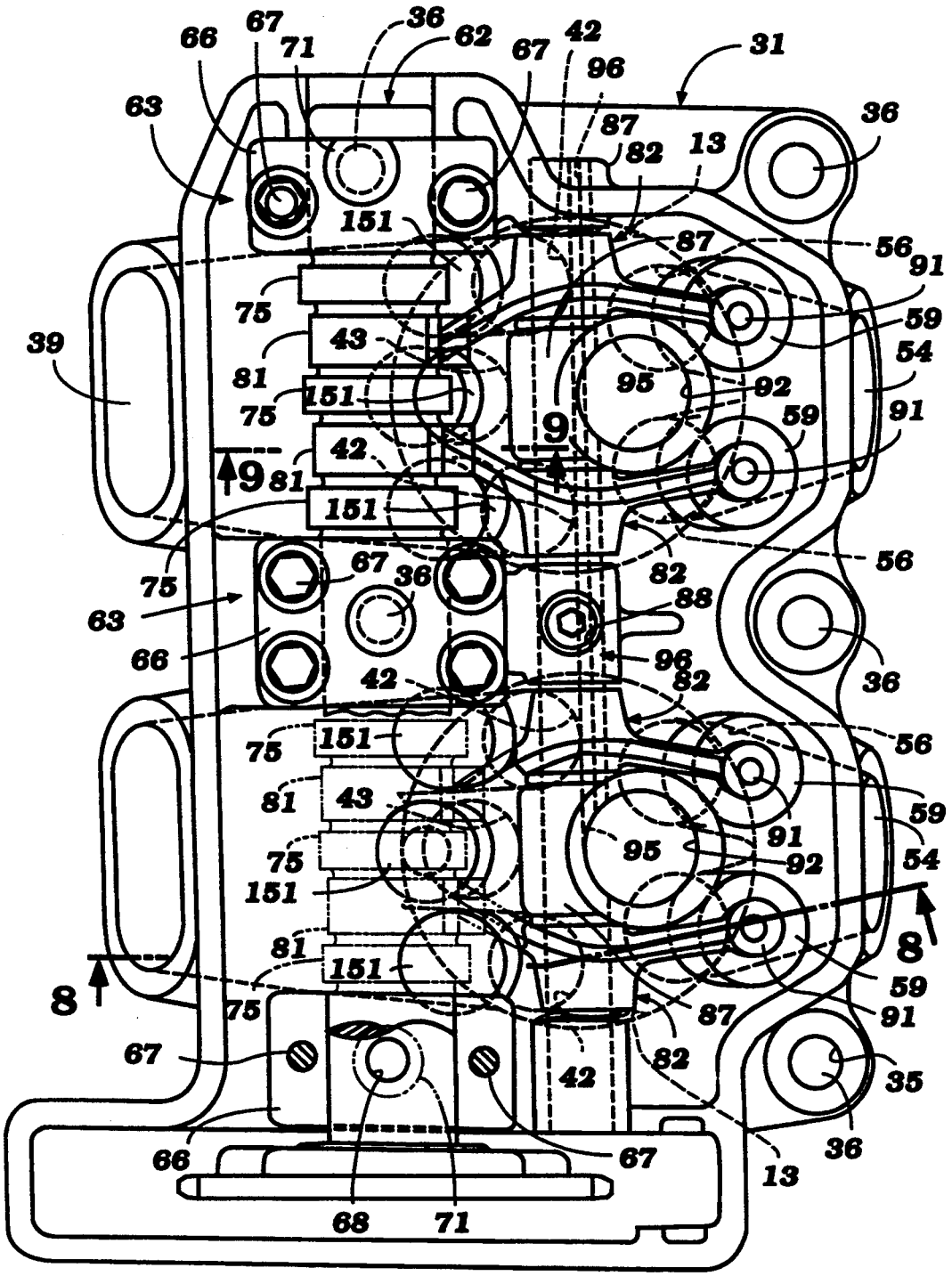
FIG. 7 is a top plan view, in part similar to FIGS. 2 and 6, and shows yet another embodiment of the invention.
Figure 8:
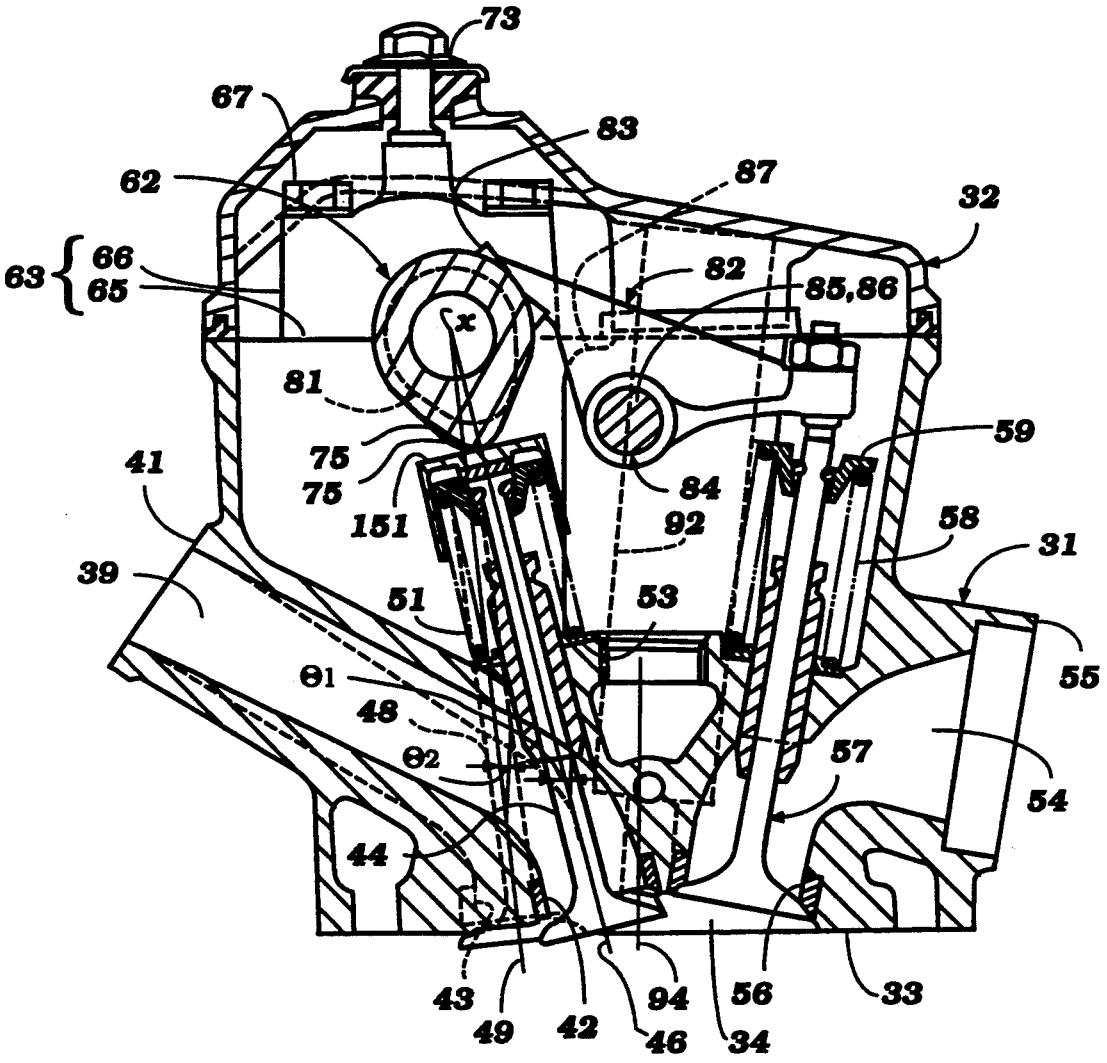
FIG. 8 is a cross-sectional view taken along the line 8—8 of FIG. 7.

In the embodiments of the invention as thus far described, the intake valves have been operated by either one or a plurality of rocker arms from either a single or a plurality of intake cam lobes on the camshaft. FIGS. 6–8 show another embodiment of the invention, which is generally similar to the embodiment of FIGS. 1–5 but in which the intake valves are operated by thimble tappets and direct engagement with the intake camshaft lobes. Aside from this difference, this embodiment is the same as the embodiment of FIGS. 1–5 and, for that reason, components which are the same or substantially the same have been identified by the same reference numerals and will be described again only insofar as is necessary to understand the construction and operation of this embodiment.

In this embodiment, the cylinder head is provided with suitable bores in which thimble tappets 151 are reciprocally supported and which are engaged by respective intake cam lobes 75. The cam lobes 75 of this embodiment may be offset relative to each other so as to cause the intake valves 44 and 48 to all open at the same time. It should be noted that in this embodiment, the axes of reciprocation of the intake valves 44 and 48 intersect at a point X which is coincident with the axis of rotation of the camshaft 62. As with the previously described embodiments, the cam lobes 75 may be configured to provide different valve timing if desired.

Figure 9:
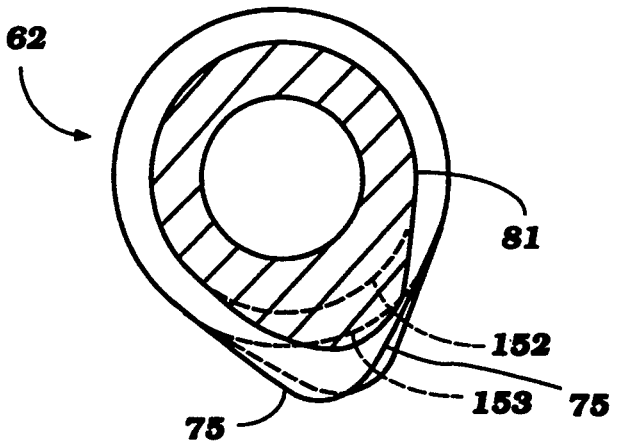
FIG. 9 is an enlarged cross-sectional view taken along the line 9—9 of FIG. 7.

It should also be noted from FIG. 7 that the exhaust cam lobes 81 overlie the sides of the tappet 151 which engages the center intake valve 48 and the sides of the Side intake valves 44. This permits a compact construction. However, as shown in FIG. 9, the exhaust cam lobes 81 must be formed with a smaller height so as to avoid interference with the tappets 151 that could cause them to be actuated. The heel diameter 152 of the exhaust tappet is also much smaller than the heel diameter 153 of the intake tappets for the same reason. In all other regards, this embodiment is the same as those previously described and, for that reason, further description of this embodiment is not believed to be necessary.

It should be readily apparent from the foregoing description that the described embodiments of the invention provide a very effective and compact single overhead cam five valve per cylinder engine. The construction is such that a centrally positioned spark plug may be employed that extends almost parallel to the cylinder bore axis and thus is easily accessible. In addition, this construction permits a much more compact engine and one in which the combustion chamber shape may be made optimum without constraint caused by the valve train. Of course, the foregoing description is that of preferred embodiments of the invention and various changes and modifications may be made without departing from the spirit and scope of the invention as defined by the appended claims.

I claim:

1. A cylinder head assembly for a five valve, single overhead camshaft engine comprising a cylinder head defining at least in part a combustion chamber, a first set of three valves supported for reciprocation along respective axes by said cylinder head on one side of a first plane passing through said combustion chamber, a second set of two valves supported for reciprocation along respective axes by said cylinder head on the other side of said first plane, a camshaft journaled for rotation relative to said cylinder head about an axis parallel to said first plane and offset from said first plane on said one side a greater distance than all of the valves of said first set, means for actuating said first set of valves from said camshaft comprising at least a first cam lobe positioned substantially on a second plane passing perpendicular to said first plane and passing through the center of said combustion chamber, a pair of cam lobes positioned on opposite sides of said first cam lobe, a pair of rocker arms each engaging a respective one of said pair of cam lobes and a respective one of said second set of valves for operating said second set of valves from said camshaft, and a spark plug mounted in said cylinder head between said pair of rocker arms.

2. A cylinder head assembly as set forth in claim 1 wherein the spark plug extends in a direction substantially parallel to the axis of a cylinder bore associated with the cylinder head.

3. A cylinder head assembly as set forth in claim 1 wherein the pair of rocker arms are pivotally supported on a single rocker arm shaft.

4. A cylinder head assembly as set forth in claim 3 wherein the single rocker arm shaft lies on the other side of the first plane.

5. A cylinder head assembly as set forth in claim 3 wherein the single rocker arm shaft passes adjacent an area where the spark plug is positioned and wherein the single rocker arm shaft is provided with a recessed area to clear the spark plug.

6. A cylinder head assembly as set forth in claim 3 further including drain passage means extending from a well in the cylinder head that receives the spark plug to an end surface thereof for draining of water from the spark plug well.

7. A cylinder head assembly as set forth in claim 3 wherein the rocker arms for operating the pair of valves have intermediate bearing portions journaled on the rocker arm shaft and end portions angularly related to the intermediate portions so as to provide a curved configuration for clearing the spark plug.

8. A cylinder head assembly as set forth in claim 1 wherein the means for journaling the camshaft on the cylinder head comprises a pair of bearing surfaces formed on the camshaft outwardly of the pair of cam lobes with no bearing surfaces being formed between the pair of cam lobes.

9. A cylinder head assembly as set forth in claim 8 wherein the means for actuating the first set of valves comprises a single rocker arm engaged with a single cam lobe and having a trifurcated end portion engaged with each of said valves of said first set.

10. A cylinder head assembly as set forth in claim 1 wherein the means for actuating the first set of valves from the camshaft comprises a first set of three cam lobes, one of said three cam lobes being the cam lobe positioned between said pair of cam lobes and the other two of said first set of cam lobes being each positioned outwardly of a respective one of the pair of cam lobes.

11. A cylinder head assembly as set forth in claim 10 wherein the pair of rocker arms are pivotally supported on a single rocker arm shaft.

12. A cylinder head assembly as set forth in claim 11 wherein the pivotal supports of the pair of rocker arms on the single rocker armshaft are aligned with the second and third cam lobes of the first set of cam lobes.

13. A cylinder head assembly as set forth in claim 12 wherein the single rocker armshaft lies on the other side of the plane.

14. A cylinder head assembly as set forth in claim 12 wherein the single rocker armshaft passes adjacent an area where the spark plug is positioned and wherein the single rocker arm shaft is provided with a recessed area to clear the spark plug.

15. A cylinder head assembly as set forth in claim 12 wherein the rocker arms for operating the pair of valves have intermediate bearing portions journaled on the rocker arm shaft and end portions angularly related to the intermediate portions so as to provide a curved configuration for clearing the spark plug.

16. A cylinder head assembly as set forth in claim 8 wherein at least one of the first set of valves is directly operated by the first cam lobe on the camshaft.

17. A cylinder head assembly as set forth in claim 16 wherein the pair of cam lobes overlap a keeper retainer assembly of the directly operated valve of the first set and wherein the pair of cam lobes have a smaller diameter than the cam lobe directly operating the valve of the first set of valves.

18. A cylinder head assembly as set forth in claim 17 wherein the means for operating the first set of valves further includes a second and third cam lobe associated with the remaining valves of the first set and positioned outwardly of the pair of cam lobes.

19. A cylinder head assembly as set forth in claim 18 wherein all of the valves of the first set are directly operated by the cam lobes of the first set.

20. A cylinder head assembly as set forth in claim 19 wherein the pair of cam lobes overlap a tappet of the directly operated valve of the first set and wherein the pair of cam lobes have a smaller diameter than the cam lobe directly operating the valve of the first set of valves.

21. A cylinder head assembly as set forth in claim 8 wherein the means for operating the first set of valves comprises the first cam lobe and second and third cam lobes each associated with a respective one of the other valves of the first set.

22. A cylinder head assembly as set forth in claim 21 wherein all of the first set of valves are directly operated by a respective cam lobe.

23. A cylinder head assembly as set forth in claim 21 wherein each of the valves of the first set is operated by a respective cam lobe of the first set via a rocker arm.

24. A cylinder head assembly as set forth in claim 23 wherein all of the rocker arms operating the first set of valves are pivotally supported on a common rocker arm shaft.

25. A cylinder head assembly as set forth in claim 24 wherein the single rocker arm shaft is disposed outwardly of the cylinder bore axis and below the tips of the valves operated thereby.

26. A cylinder head assembly as set forth in claim 1 wherein the valves of the first set comprises a pair of side valves reciprocal about axes that lie in a common plane disposed at an acute angle to the first plane and a center valve reciprocal about an axis disposed at an acute angle to the first plane and at a lesser acute angle than the common plane containing the reciprocal axis of the side valves.

27. A single overhead camshaft arrangement for a multiple valve internal combustion engine comprising a cylinder head adapted to be affixed to a cylinder block to close one end of a cylinder bore formed therein, a camshaft supported for rotation relative to said cylinder head by a pair of bearings spaced apart a distance substantially equal to the diameter of said cylinder bore, at least four cam lobes formed on said camshaft between said spaced bearings for operating a plurality of valves supported in said cylinder head for reciprocation and serving said cylinder bore, said plurality of valves comprising five valves consisting of a first set of three valves supported for reciprocation along respective axes by said cylinder head on one side of a first plane passing through the axis or the cylinder bore, a second set of two valves supported for reciprocating along respective axes by said cylinder head on the other side of said first plane, means for directly actuating said first set of valves from said camshaft comprising a first set of three cam lobes each directly actuating a respective valve of said first set, one cam lobe of said first set being positioned substantially on a second plane passing perpendicular to said first plane and passing through the axis of said cylinder bore and a first pair of cam lobes positioned adjacent said bearings, a second pair of cam lobes positioned on opposite sides of said first cam lobe and between said first pair of cam lobes, a pair of rocker arms each engaging a respective one of said second pair of cam lobes and a respective one of said second set of valves for operating said second set of valves from said camshaft, said pair of rocker arms being pivotally supported on a single rocker arm shaft lying on the other side of said first plane.

28. A single overhead camshaft arrangement for a multiple valve internal combustion engine comprising a cylinder head adapted to be affixed to a cylinder block to close one end of a cylinder bore formed therein, a camshaft supported for rotation relative to said cylinder head by a pair of bearings spaced apart a distance substantially equal to the diameter of said cylinder bore, at least five cam lobes formed on said camshaft between said spaced bearings for operating a plurality of valves supported in said cylinder head for reciprocation and serving said cylinder bore, said plurality of valves comprising five valves consisting of a first set of three valves supported for reciprocation along respective axes by said cylinder head on one side of a first plane passing through said combustion chamber, a second set of two valves supported for reciprocation along respective axes by said cylinder head on the other side of said fist plane, lobes, means for actuating said first set of valves from said camshaft comprising at least a first cam lobe positioned substantially on a second plane passing perpendicular to said first plane and passing through the center of said combustion chamber and a first pair of cam lobes positioned adjacent said bearings, a first set of three rocker arms journaled on a common rocker arm shaft and each engaged with one of said first cam lobe and said first pair of cam lobes and a respective valve of said first set, a second pair of cam lobes positioned on opposite sides of said first cam lobe and between said first pair of cam lobes, a pair of rocker arms each engaging a respective one of said second pair of cam lobes and a respective one of said second set of valves for operating said second set of valves from said camshaft, said common rocker arm shaft being disposed outwardly of the cylinder bore axis and below the tips of said second set of valves.

29. An arrangement as set forth in claim 28 wherein the valves of the first set comprises a pair of side valves reciprocal about axes that lie in a common plane disposed at an acute angle to the first plane and a center valve reciprocal about an axis disposed at an acute angle to the first plane and at a lesser acute angle than the common plane containing the reciprocal axis of the side valves.

30. A cylinder head arrangement for an overhead camshaft internal combustion engine, said cylinder head forming in part a combustion chamber, at least three poppet valves for serving said combustion chamber, a tappet associated with one of said valves for operating said valve, a camshaft journaled for rotation relative to said cylinder head, said camshaft having a first lobe cooperating with said tappet for operating said one valve, a second and a third lobe formed on said camshaft on opposite sides of said first lobe and spaced apart a distance less than the diameter of said tappet, said second and third lobes having a smaller effective diameter than said first lobe, and means for operating a second poppet valve from said second cam lobe and a third poppet valve from said third cam lobe.

31. A cylinder head assembly for a five valve, single overhead camshaft engine comprising a cylinder head defining at least in part a combustion chamber, a first set of three valves supported for reciprocation along respective axes by said cylinder head on one side of a first plane passing through said combustion chamber, a second set of two valves supported for reciprocation along respective axes by said cylinder head on the other side of said first plane, a camshaft journaled for rotation relative to said cylinder head about an axis parallel to said first plane and on one side thereof, means for actuating said first set of valves from said camshaft comprising at least a first cam lobe positioned substantially on a second plane passing perpendicular to said first plane and passing through the center of said combustion chamber, a pair of cam lobes positioned on opposite sides of said first cam lobe, a pair of rocker arms journaled on a common rocker arm shaft and each engaging a respective one of said pair of cam lobes and a respective one of said second set of valves for operating said second set of valves from said camshaft, and a spark plug mounted in said cylinder head between said pair of rocker arms, said rocker arm shaft passing adjacent an area where said spark plug is positioned and being provided with a recessed area to clear the spark plug.

32. A cylinder head assembly for a five valve, single overhead camshaft engine comprising a cylinder head defining at least in part a combustion chamber, a first set of three valves supported for reciprocation along respective axes by said cylinder head on one side of a first plane passing through said combustion chamber, a second set of two valves supported for reciprocation along respective axes by said cylinder head on the other side of said first plane, a camshaft journaled for rotation relative to said cylinder head about an axis parallel to said first plane and on one side thereof, means for actuating said first set of valves from said camshaft comprising a first set of three cam lobes, the center of which is positioned substantially on a second plane passing perpendicular to said first plane and passing through the center of said combustion chamber, a pair of cam lobes positioned on opposite sides of said center cam lobe, a pair of rocker arms pivotally supported on a single rocker arm shaft and each engaging a respective one of said pair of cam lobes and a respective one of said second set of valves for operating said second set of valves from said camshaft, the pivotal supports of said pair of rocker arms on said single rocker arm shaft being aligned with the second and third cam lobes of said first set of cam lobes and a spark plug mounted in said cylinder head between said pair of rocker arms.

33. A cylinder head assembly as set forth in claim 32 wherein the single rocker arm shaft lies on the other side of the plane.

34. A cylinder head assembly as set forth in claim 32 wherein the single rocker arm shaft passes adjacent an area where the spark plug is positioned and wherein the single rocker arm shaft is provided with a recessed area to clear the spark plug.

35. A cylinder head assembly as set forth in claim 32 wherein the rocker arms for operating the pair of valves have intermediate bearing portions journaled on the rocker arm shaft and end portions angularly related to the intermediate portions so as to provide a curved configuration for clearing the spark plug.

36. A cylinder head assembly for a five valve, single overhead camshaft engine comprising a cylinder head defining at least in part a combustion chamber, a first set of three valves supported for reciprocation along respective axes by said cylinder head on one side of a first plane passing through said combustion chamber, a second set of two valves supported for reciprocation along respective axes by said cylinder head on the other side of said first plane, a camshaft journaled for rotation relative to said cylinder head about an axis parallel to said first plane and on one side thereof, means for actuating said first set of valves from said camshaft comprising at least a first cam lobe positioned substantially on a second plane passing perpendicular to said first plane and passing through the center of said combustion chamber and directly actuating at least one of said first set of valves, said one valve having a keeper retainer assembly for engagement with a valve spring, a pair of cam lobes positioned on opposite sides of said first cam lobe in overlapping relation to said keeper retainer assembly of said one valve of said first set, a pair of rocker arms each engaging a respective one of said pair of cam lobes and having a respective one of said second set of valves for operating said second set of valves from said camshaft, said pair of cam lobes a smaller diameter than said first cam lobe, the means for journaling said camshaft on said cylinder head comprising a pair of bearing surfaces formed on said camshaft outwardly of said pair of cam lobes with no bearing surfaces being formed between said pair of cam lobes, and a spark plug mounted in said cylinder head between said pair of rocker arms.

37. A cylinder head assembly as set forth in claim 36 wherein the means for operating the first set of valves further includes a second and third cam lobe associated with the remaining valves of the first set and positioned outwardly of the pair of cam lobes.

38. A cylinder head assembly as set forth in claim 37 wherein all of the valves of the first set are directly operated by the cam lobes of the first set.

39. A cylinder head assembly as set forth in claim 38 wherein the pair of cam lobes overlap a tappet of the directly operated valve of the first set and wherein the pair of cam lobes have a smaller diameter than the cam lobe directly operating the valve of the first set of valves.

40. A cylinder head assembly for a five valve, single overhead camshaft engine comprising a cylinder head defining at least in part a combustion chamber, a first set of three valves supported for reciprocation along respective axes by said cylinder head on one side of a first plane passing through said combustion chamber, a second set of two valves supported for reciprocation along respective axes by said cylinder head on the other side of said first plane, a camshaft journaled for rotation relative to said cylinder head about an axis parallel to said first plane and on one side thereof, means for directly actuating said first set of valves from said camshaft comprising at least a first cam lobe positioned substantially on a second plane passing perpendicular to said first plane and passing through the center of said combustion chamber and second and third cam lobes, each directly operating a valve of said first set, a pair of cam lobes positioned on opposite sides of said first cam lobe, a pair of rocker arms each engaging a respective one of said pair of cam lobes and a respective one of said second set of valves for operating said second set of valves from said camshaft, and a spark plug mounted in said cylinder head between said pair of rocker arms.

41. A cylinder head assembly for a five valve, single overhead camshaft engine comprising a cylinder head defining at least in part a combustion chamber, a first set of three valves supported for reciprocation along respective axes by said cylinder head on one side of a first plane passing through said combustion chamber, a second set of two valves supported for reciprocation along respective axes by said cylinder head on the other side of said first plane, a camshaft journaled for rotation relative to said cylinder head about an axis parallel to said first plane and on one side thereof, means for actuating said first set of valves from said camshaft comprising at least a first cam lobe positioned substantially on a second plane passing perpendicular to said first plane and passing through the center of said combustion chamber and second and third cam lobes each operating a respective rocker arm, all of said rocker arms operating, said first set of valves being pivotally supported on a common rocker arm shaft, a pair of cam lobes positioned on opposite sides of said first cam lobe, a pair of rocker arms each engaging a respective one of said pair of cam lobes and a respective one of said second set of valves for operating said second set of valves from said camshaft, and a spark plug mounted in said cylinder head between said pair of rocker arms.

* * * * *